United States Patent [19]

Smith

[11] 4,373,904

[45] * Feb. 15, 1983

[54] INFRA-RED GENERATOR

[76] Inventor: Thomas M. Smith, 114 Villinger Ave., P.O. Box C-94, Cinnaminson, N.J. 08077

[ * ] Notice: The portion of the term of this patent subsequent to Jul. 12, 1994, has been disclaimed.

[21] Appl. No.: 178,121

[22] Filed: Aug. 14, 1980

Related U.S. Application Data

[63] Continuation-in-part of Ser. No. 20,079, Mar. 13, 1979, Pat. No. 4,290,746, Ser. No. 94,901, Nov. 16, 1979, Pat. No. 4,272,238, Ser. No. 952,332, Oct. 18, 1978, Pat. No. 4,326,843, and Ser. No. 775,838, Mar. 9, 1977, Pat. No. 4,272,237, which is a continuation-in-part of Ser. No. 701,687, Jul. 1, 1976, abandoned, Ser. No. 906,229, May 18, 1978, Pat. No. 4,157,155, and Ser. No. 674,409, Apr. 7, 1976, Pat. No. 4,035,132.

[51] Int. Cl.[3] ..... F23D 13/12

[52] U.S. Cl. ..... 431/328; 431/7

[58] Field of Search ..... 431/328, 329, 7

[56] References Cited

U.S. PATENT DOCUMENTS 3,008,513 11/1961 Holden ..... 431/328
3,785,763 1/1974 Bratko ..... 431/328
3,824,064 7/1974 Bratko ..... 431/328
4,035,132 7/1977 Smith ..... 431/328

*Primary Examiner*—Carroll B. Dority, Jr.
*Attorney, Agent, or Firm*—Connolly and Hutz

[57] ABSTRACT

Improved gas-fired radiant heater has porous refractory panel mounted by its edges on a support to define a gaseous combustion mixture plenum from which the mixture flows through the panel to burn at its outer face, and a conduit for non-combustible gas extends along the margin of the panel and discharges the non-combustible gas through the panel all along its margin to keep the combustion mixture from escaping through the panel edges where burning can damage the panel. No further sealing of the panel margin is needed, but the sealing is effected with less of the non-combustible gas if the panel edges are compressed so as to reduce their thickness about 10%. One or more of the margins of a rectangular panel can be arranged as a depending flange with its mounting at least partially recessed so that two or more panels can be juxtaposed at such margins to form an effectively continuous radiating surface of relatively large size. The air seal construction also makes such heaters very practical for firing house heating furnaces.

9 Claims, 19 Drawing Figures

Zone 2 Mixture In
172
176
110
164
162
180
178
184
166
160
168
182
174
Zone 1 Mixture In
152
194
190
188
171
199
136
158
197
193
196
186
154
192
198
195
150
118
134
156
134
142
137
120
140
114
112
116
122
124
129
130
110
121
132
126
128
127

INFRA-RED GENERATOR

This application is a continuation-in-part of applications Ser. Nos. 20,079 filed Mar. 13, 1979 (U.S. Pat. No. 4,290,746 granted Sept. 22, 1981), 94,901 filed Nov. 16, 1979 (U.S. Pat. No. 4,272,238 granted June 9, 1981), 952,332 filed Oct. 18, 1978 (U.S. Pat. No. 4,326,843 granted Apr. 27, 1982) and 775,838 filed Mar. 9, 1977 (U.S. Pat. No. 4,272,237 granted June 9, 1981), the last-mentioned being a continuation-in-part of applications Ser. No. 701,687 filed July 1, 1976 (abandoned) (subsequently refiled), Ser. No. 906,229 filed May 18, 1978 (U.S. Pat. No. 4,157,155 granted June 5, 1979), and Ser. No. 674,409 filed Apr. 7, 1976 (U.S. Pat. No. 4,035,132 granted July 12, 1977).

The present invention relates to gas-fired radiant heaters as in U.S. Pat. Nos. 3,785,763, 3,248,099 and 3,824,064, and to equipment with which they are used, which burners have a panel of interfelted ceramic fibers, a gaseous combustion mixture being continually passed through the panel and burned at the panel face from which it emerges. The combustion takes the form of a flame that extends over the entire area of the face from which the combustion mixture emerges, the flame length being very small so that the surface fibers at the flame are heated to red heat or hotter and form an essentially continuous wall of heat that makes a very effective heat radiator. By increasing or decreasing the rate of flow and/or changing the composition of the combustion mixture, the temperature of the heated fibers can be controlled.

Among the objects of the present invention is the provision of novel heater structures that are simpler to construct or provide improved operation or both.

The foregoing as well as additional objects of the present invention will be more fully understood from the following description of several of its exemplifications, reference being made to the accompanying drawings in which.

According to the present invention a gas-fired radiant heater having a supported porous refractory panel through which a gaseous combustion mixture is passed and on the face of which the mixture is burned as it emerges, is operated with improved results by passing a narrow stream of relatively cold non-combustible gas through the panel immediately adjacent the panel support as the foregoing burning takes place.

This non-combustible gas stream acts as a barrier which directs the combustible mixture through the refractory panel and minimizes leakage of combustible gases past the frame members that hold the panel. By acting as a barrier to the combustible mixture, the non-combustible gas stream significantly reduces the importance of sealing the matrix in place, greatly reducing burner assembly time and parts tolerance. The non-combustible gas stream also greatly reduces contact of the hot gaseous products resulting from the combustion at the panel's surface, with the frame members, keeping them much cooler and reducing heat warpage.

The narrow stream of relatively cold gas is conveniently provided by holding the porous panel on a ledge carried by the combustion mixture plenum covered by the porous panel, and a slot extends along the ledge and is connected to a supply of the non-combustible gas.

Another feature is the construction of a gas-fired radiant heater with a back plate, a tubular frame member having lengths extending around the margin of the back plate and sealed to it to define a combustion mixture plenum between the opposing lengths of the frame member and on one face of the back plate, the frame member having means for receiving a supply of gas into its tubular interior and also having a face receiving a porous refractory panel to cover the plenum.

Figure 1:
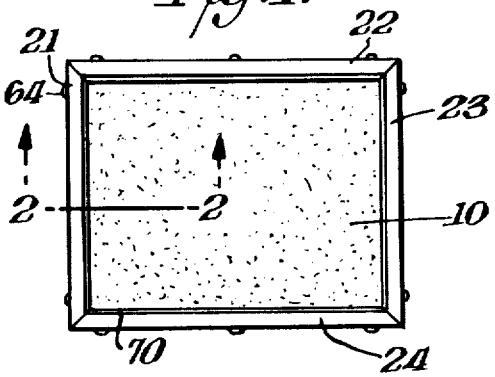
FIG. 1 is a face view of an infra-red heater according to the present invention.
Figure 2:
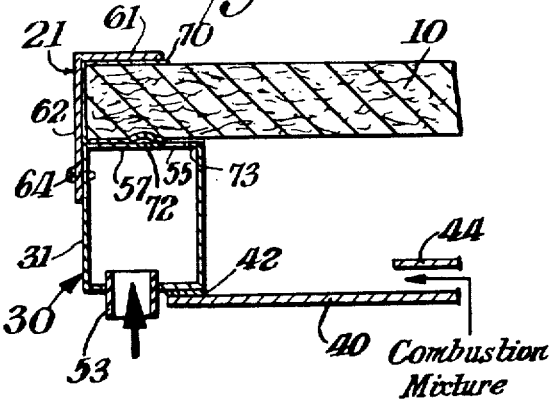
FIG. 2 is a sectional detail view of the heater of FIG. 1, taken along the line 2—2.
Figure 4:
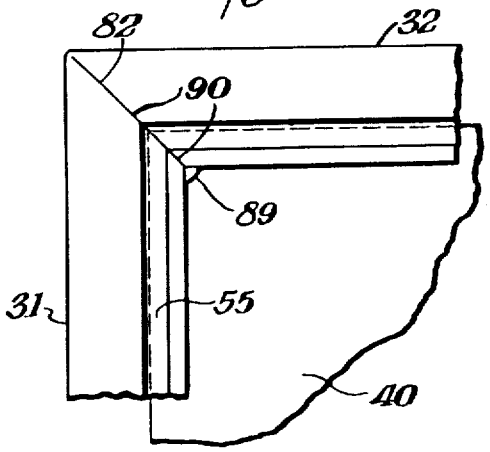
FIG. 4 is a detail view similar to that of FIG. 1, showing some structural features suitable for the infra-red heaters of the present invention.

Turning now to the drawings, the radiant heater of FIGS. 1 and 2 has the usual porous refractory panel 10 held at its margins by upper frame members 21, 22, 23, 24, against a lower frame 30. Frame 30 has four lengths of tubular supports, two of which are shown in FIG. 4 at 31, 32, secured to the margins of a rectangular back plate 40 by welding, brazing, cementing as with epoxy or other cement, or otherwise joined in a gas-tight manner, indicated at 42. Back plate 40 and the four tubular supports thus define a plenum for the combustion mixture fed to the panel 10. A pipe connection can be welded through an aperture in the back plate in the standard manner for receiving a combustion mixture supply conduit, and a baffle a portion of which is shown at 44, can be fitted to help equalize the combustion mixture flow toward all portions of panel 10.

One or more lengths of the tubular support frame can also have a connector 53 welded through an aperture for the supply of air from a pump or a storage tank or the like. A slot 55 is also provided along the top wall 57 of the support frame for discharge of the air from the interior of the tubular support lengths through the margin of the porous refractory panel. The individual tubular supports are mitered together at the corners of the frame with the mitered joint sealed as by welding, brazing, cementing or other secure joining, to keep combustion mixture from leaking out of the plenum as well as from being nonuniformly diluted with the air moving through the tubular supports.

The upper frame members 21, 22, 23, 24 are shown as angles each having an upper flange 61 that overlies a margin of the outer face of panel 10, and a depending flange 62 that is secured to a lower frame member, as by means of the screws 64. The screws can be threadedly received in the outer walls of the tubular support frame, and can pass through openings in the flange 62. Such openings can be elongated in the direction perpendicular to the wall 57 if adjustability is to be provided for the spacing between wall 57 and flange 61.

The porous panel 10 permits the gaseous combustion mixture to freely pass through it so that pressures in the plenum need only be about 2 to 7 inches of water above the ambient atmosphere to provide very effective uniform combustion over the entire outer face of panel 10. A similar air pressure in the interior of the tubular support will cause streams of air to pass through the margin of porous panel 10 and emerge from its outer face. The porous interfelted fibrous structure of the panel surprisingly does not permit much change in the width of the air stream moving through the panel, particularly when the pressure that propels the air stream from the tubular support is within an inch or two of water height with respect to the pressure that propels the gaseous combustion mixture from the plenum. This is readily noted when the burner is in operation inasmuch as the outer surface of the panel glows red hot over its entire area except for a narrow and sharply defined band around its periphery and adjacent the outer frame members.

The frame members are thus keppt much cooler than they would be without the marginal air stream, particularly where the burners are operated with the outer surface of their panels 10 positioned in a generally vertical plane, or positioned facing downwardly. In those positions the very hot gaseous products resulting from the combustion at the panel's surface, rise and flow over the frame members of the burners of U.S. Pat. Nos. 3,785,763 and 3,824,064 to heat them up to high temperatures that can reach 1000° F. in some cases. The marginal air stream of the present invention, on the other hand, acts as a barrier layer against the hot combustion products, keeping those hot gases from directly reaching the frame members in substantial volume. Marginal streams taken from the air at ambient temperatures and passing through a panel as much as 1½ inch thick will generally keep the outer faces of 1/16 inch thick steel frame members several hundred degrees F below the temperatures corresponding frame members reach in the constructions of the above patents. The temperature of the frames of the present invention will be even lower where the heater is used to heat objects that do not cause much reflection of the burner's radiating heat back to those frame members.

A further benefit is that by minimizing contact of the hot combustion gases with the frame members and thus keeping them much cooler, emission of radiation from the frame members themselves is greatly reduced. The heaters can be positioned much closer to their targets than prior art heaters, and still permit minimizing damage to the target in the event of emergency shutdown. The porous refractory panel itself cools down very sharply when the fuel gas flow into the plenum is stopped and the air flow is maintained, but the frame members of the prior art heaters take much longer to cool down. When using such heaters to heat a moving web of heat-sensitive material, the heaters are preferably arranged to generate much more heat than the web can tolerate should the web stop moving. With the prior art heaters the rate of cool-down for the frame members can become a critical factor that determines how close the prior art heaters can be brought to the web without damaging the web in the event the web suddenly stops and the heater cannot be mechanically pulled away from it. The heaters of the present invention don't have to be pulled away and can therefore be installed in a less expensive manner. Their closer proximity to the target makes the heat transfer to the target more efficient and enables the use of less fuel to achieve the desired results.

Moreover in some treatments such as the volatilizing of water from a target web, the most effective radiation wave-lengths are in a range that is most efficiently produced at relatively low radiation temperatures. By moving the heaters closer to their targets, their radiation temperatures can be diminished to thus make more efficient use of the fuel energy and with less fuel, without decreasing the treatment effectiveness.

Heaters placed very close to targets may be desirably made to extend beyond the edges of the target to attain greater treatment uniformity. Each such extension can be approximately equal to the distance from the heater to the target, for good results.

Locating slot 55 immediately opposite the panel margins alongside the inner edges of the upper frame members 21, 22, 23, 24 helps guide the protective streams to the desired location. This guiding action is further improved by sealing the edges of the panel so that not much non-combustible gas can escape laterally. FIG. 2 illustrates a prior art edge sealing technique according to which a thin foil of aluminum 70, about 2 mils thick, is wrapped around each panel edge, and the lower face of the foil is sealed against wall 57 by a narrow line of sealant 72 such as a silicone rubber vulcanized in place.

When edge sealing of the panel is desired, the sealant 72 can be of a material such as ordinary rubber or neoprene, that need not be resistant to high temperatures. However during normal operation of the burner construction of the present invention, only air from the interior of the tubular support will tend to leak out from the margins of the panel. Such leakage is not dangerous nor is it extensive when sealant 72 is entirely omitted. Omitting the foil 70 can cause extensive air leakage unless the outer frame is a very close fit against the support frame. The marginal air stream with or without leakage keeps the combustion mixture from leaking out the edges of the panel.

The slot 55 does a very effective job when it is about ¼ inch wide, although it can be as little as 1/16 inch or as much as ½ inch wide and still give good results. The width of protective gas stream emerging from the face of the porous panel is generally a little larger than the width of the slot, and changes in gas pressure vary this broadening effect. A desirable gas pressure in the tubular frame is one that approximately equals, or is slightly higher than, the pressure in the combustion mixture plenum.

Figure 18:
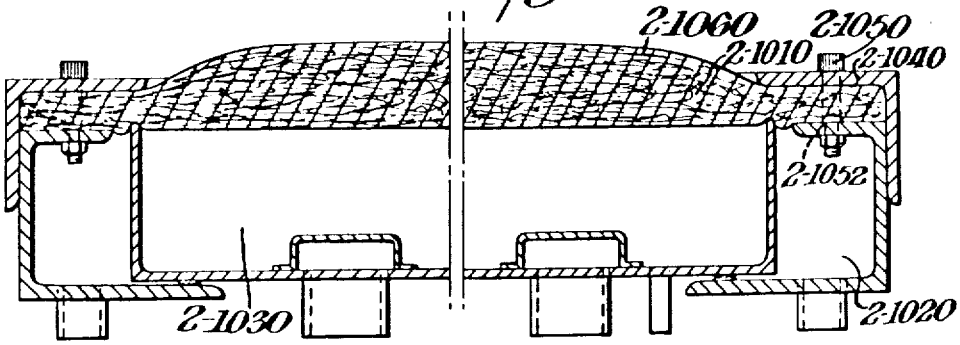
Figure 19:
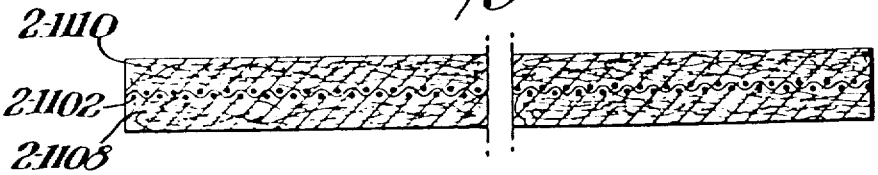

The cooling and combustion-mixture-lead-blocking effects of the marginal stream of the present invention are also obtained when the discharge slot 55 is located further toward the outer face of the frames so that the gas discharged through the slot is directed partly or completely at frame flange 61. Most of the discharged gas will then move along the interior of panel 10 and escape just past the inner margin of that frame flange. Such a construction is illustrated in FIG. 18.

It is not essential to make the tubular support members gas-tight where they are threadedly engaged by screws 64. Even where relatively expensive inert gas is used rather than air, the leakage through such threaded connections is miniscule as compared with the discharge through slot 55. The threaded engagement can be sealed however, as by applying pipe-thread dope or the like to the mating threads before they are engaged. Alternatively the connection between the outer and inner frames can be made as shown in U.S. Pat. Nos. 3,785,763 and 3,824,064.

Figure 3:
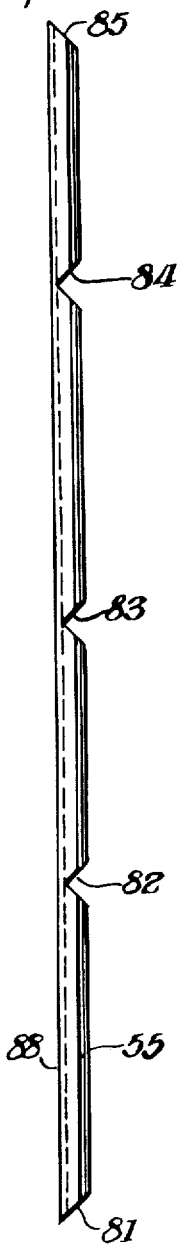
FIG. 3 is a plan view of a component that can be used in the making of the heater of FIGS. 1 and 2.

Instead of making tubular frame 30 of four separate lengths, it can be made from a single piece of formed sheet metal, as illustrated in FIG. 3. An elongated strip of sheet metal twenty to fifty thousandths of an inch thick can be bent into the form illustrated by the sectional view in FIG. 2, or a standard metal tube of rectangular section can be milled to cut the slot 55 through one wall, and the resulting shape then subjected to mitering cuts 81, 82, 83, 84 and 85 as shown in FIG. 3. These cuts leave wall 88 intact, and the mitered length is then bent to form a one-piece tubular frame a corner of which is shown in FIG. 4. The inner edge of each corner is then welded, brazed, cemented or otherwise joined as at 89 to seal the entire height of that corner, and the tubular frame is ready for similar joining to the back plate 40.

It is not necessary to seal the outer face 90 of the mitered joints, particularly if the joints are a close fit. A little extra leakage at those locations from the interior of the tubular frame does no particular harm. However, that outer face can be sealed, especially if lateral leakage from the frame margin takes place.

The tubular frame need not extend inwardly of the slot 55, although it helps to have that frame provide an additional flat support 73 for the porous panel 10. Such support can be reduced to the thickness of the metal from which the tubular frame is made, as by suitably shaping the tube from which it is sliced, or by milling the slot 55 alongside the inner wall of the tubular frame.

Figure 5:
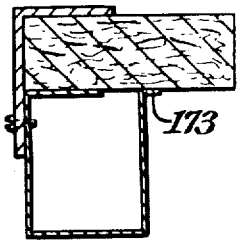
FIG. 5 is a view similar to that of FIG. 2 showing an optional method of constructing the heaters of the present invention.

FIG. 5 shows another tubular frame construction of the present invention which is simple to manufacture. Here a flat support 173 takes the place of support 73 and extends toward the center of the plenum.

It is also helpful to seal the outer margin of panel 10 as by dipping it in or brushing on a hardenable liquid resin that hardens to a temperature-resistant solid. Solutions of silicone rubber, colliodal silica, and sodium silicate are examples of suitable hardenable materials. When this type of edge sealing is used, the aluminum foil is not needed.

In some installations the panel temperature is so hot and there is so much reflection of heat from the surfaces being heated by the heater, that aluminum can be damaged. Other metals such as stainless steel can then be used for the sealing foil.

The features of the present invention are not confined to use with panels that are flat. Such panels can also be convex or concave such as when the infra-red radiation they produce is to be specially oriented. Thus a concave panel does a very good job of concentrating such rays. The panels are generally formed by felting the ceramic fibers on a screen surface, and that surface can be shaped to fit the desired panel configuration. A bonder of some sore, such as starch of sodium silicate or the like can be mixed in small amounts with the fibers to set and help hold the fibers to each other where they touch each other.

Industry has need for relatively small air-metal heat exchangers, as for use in cooling oil that lubricates an internal combustion engine. Such a heat exchanger can have as many as several hundred heat exchange tubes connected between two sheets in a leak-proof manner. Leak-proof connections for this purpose are generally made by a fusible metal sealant whose melting takes place at a temperature well above the maximum operating temperature of the heat exchanger. While tin-lead solders can be used as sealants for operating temperatures near the normal boiling point of water when no great mechanical stresses are encountered, brazing alloys including the so-called silver solders are used for higher operating temperatures or higher stresses. Such leak-proof brazing of a quantity of relatively small tubes in a tube sheet has been an awkward industrial operation that takes substantial time to assure the heating of all joints to the desired sealing temperature, and generally requires patching to seal leaks resulting from uneven heating during the original sealing.

More rapid and more effective sealing is accomplished by holding an assembly of the heat-exchange tubes each tube having one end in a sheet with the sheet in essentially horizontal position and carrying on its upper surface a quantity of fusible metallic sealant adequate to seal all tubes into the sheet, applying radiant heat downwardly on the sheet to heat it at least to the fusion point of the fusible sealant, and moving gases down from above the tube ends down through the tube ends during the heating to cause the heating to be more uniformly applied to the tubes so that the sealant rapidly seals all tubes to the sheet.

The heat for the fusion is desirably applied by a ceramic fiber burner such as described in the earlier patent applications. Their ceramic fiber mats can be made of the ceramic fibers described in U.S. Pat. No. 3,449,137, with the mat formation as described in U.S. Pat. No. 3,787,194.

The most efficient heating results of the present invention are obtained when the burner that supplies the heat envelopes the top and sides of the sheet in the tube-and-sheet assembly. Such an enveloping burner is desirably divided into sections that can be operated independently to first heat the margin of the sheet in the sheet-and-tube assembly, and then heat the center. A particularly effective burner construction for this purpose uses a single porous ceramic fiber mat in the general shape of a hat with a shallow plenum divided by a wall into two parts, air or other incombustible gas being fed through one part when that part is not being operated while the other part is being operated. The porous margin of the mat can be sealed by a high-temperature-resistant impregnant like aqueous sodium silicate, and the sealed margin clamped in place. Sheets of soft material like aluminum foil can be interposed between the sealed margin and the clamping members.

Figure 6:
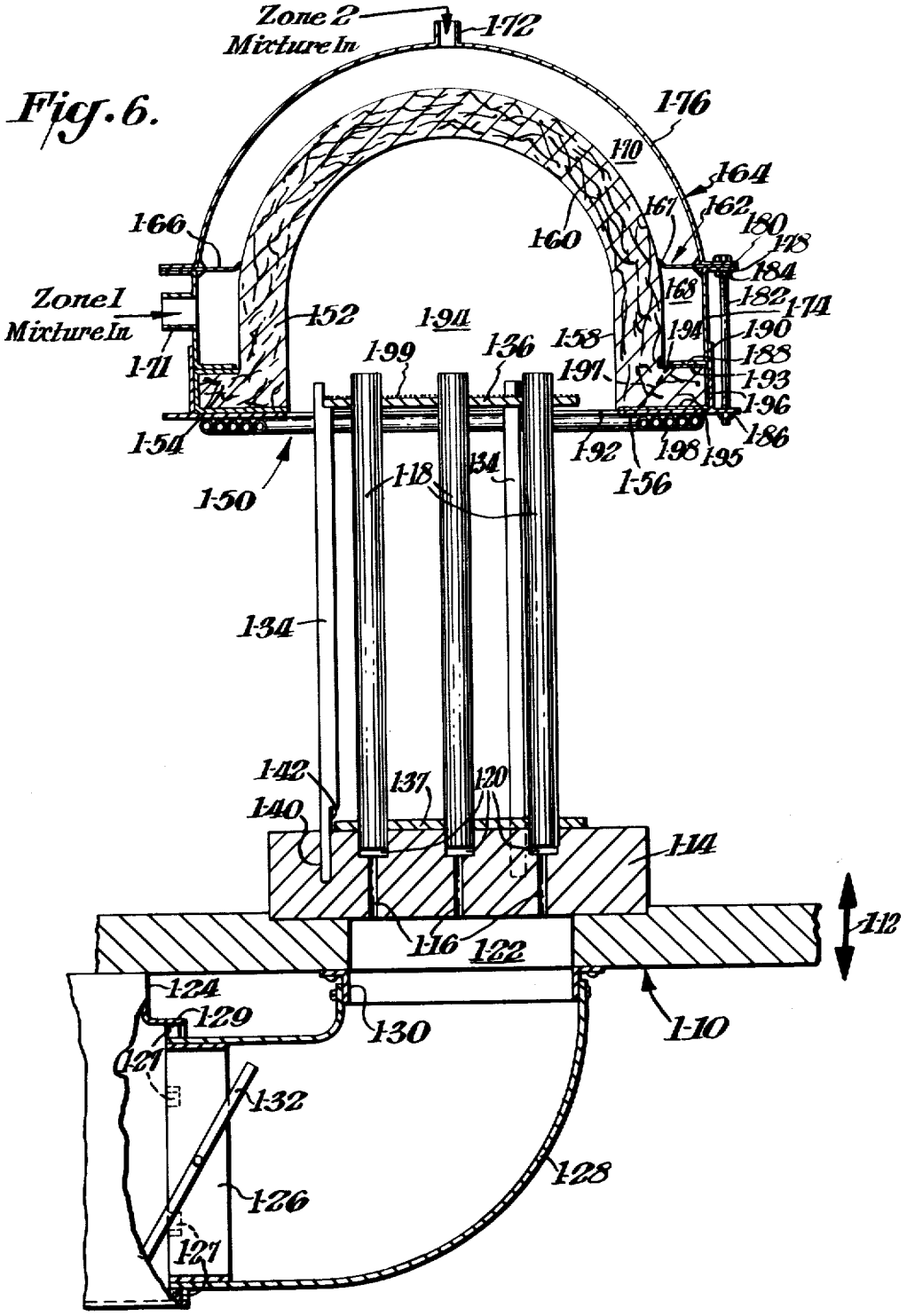
FIG. 6 is a somewhat diagrammatic vertical sectional view of one set-up for practicing the present invention.

Returning to the drawings, the apparatus of FIG. 6 includes a table 1-10 movable up and down as indicated by the two-headed arrow 1-12, and a radiant heater 1-50 positioned above the table. The table carried on its upper surface a block 1-14 having a number of vertical passageways 1-16 corresponding to the number of tubes 1-18 to be assembled into a heat exchanger, and located in a corresponding pattern. The upper ends of the passageways 1-16 are enlarged as at 1-20 to receive and position the lowest portion of each tube. The lower ends of the passageways 1-16 open at the bottom of block 1-14 over a suction opening 1-22 in table 1-10.

A blower 1-24 is shown as carried by table 1-10 and as provided with a suction tube 1-26 connected as by flexible duct 1-28 to a mounting ring 1-30 secured around opening 1-22. A butterfly valve 1-32 can be fitted to the suction tube 1-26 to enable controlling of the suction applied to the bottom of block 1-14 when the blower 1-24 is operated. Also the suction tube 1-26 can be spaced as by webs 1-27 within a wider intake mouth 1-29, so that when the blower operates it sucks air in around the suction tube 1-26 as it sucks through tube 1-26.

Block 1-14 also carries a set of supports 1-34 encircling the tubes 1-18 and holding a tube sheet 1-36 in position at or near the tops of tubes 1-18. Supports 1-34 can be removably fitted in sockets 1-40 in block 1-14, and can have their lower portion cut away as at 1-42 to allow for the positioning of another tube sheet 1-37 on block 1-14.

Heater 1-50 has a porous ceramic fiber mat 1-52 in the general shape of a hat with a horizontal flange 1-54 by which it is mounted in place behind a face plate 1-56. The crown section of the hat shape consists of a cylindrical portion 1-58 a few inches in height and a hemispherical portion 1-60, and a relatively shallow plenum space 1-62 is provided around the crown by a housing 1-64 to which the face plate 1-56 is removably secured.

The plenum space is divided by a partition 1-66 that extends around the inside of the housing, into a lower generally annular plenum portion 1-68, and an upper hemispherical shell-like portion 1-70. Separate inlet nipples 1-71, 1-72 are provided on the housing for separately supplying combustion mixture to the separate plenum portions. In the illustrated embodiment the housing 1-64 is made of a lower cylindrical section 1-74 and an upper hemispherical section 1-76. Outwardly projecting flanges 1-78, 1-80 on these housing sections where they meet, serve as attachment structure for holding the entire housing together and also holding partition 1-66 in place. To this end a number of threaded flange bolts 1-82 project through aligned sets of openings in flanges 1-78, 1-80 and in partition 1-66, and nuts 1-84 threaded on these bolts secure these members together. The bolts 1-82 are distributed around the housing, and they also project downwardly for enough to provide securing means for the face plate 1-56 which is also provided with mounting openings aligned with the bolts. An extra set of nuts 1-86 threaded on the bolts secures the face plate in place.

The burner is constructed by first assembling the housing portions 1-66, 1-74, 1-76, then forcing the preformed and prepared mat in the assembly so that it firmly engages the inner lip of partition 1-66, and then securing the face plate. The partition lip can be turned up as shown at 1-67, to make a better seal against the mat.

An internally directed flange 1-88 at the lower end of lower housing section 1-74 is used to provide a ledge against which the mat flange 1-54 is held to help seal the edges of the mat against gas leakage. A cylindrical flange 1-90 is also shown as integral with and projecting up from the top of the face plate, to encircle the mat edges and closely fit around the lower edge of the housing. This helps hold the mat in position and strengthen the face plate. A central hole 1-92 in the face plate slightly larger than the mouth of the mat 1-52 permits the top of the tube-and-sheet assembly to be brought into the burner a short distance above the mouth of the mat, as well as the movement of gases out from and into the work space 1-94 enveloped by the mat.

The burner is operated with gaseous combustion mixtures, and it is accordingly helpful to seal all locations through which such a mixture can leak out from the burner. Thus the joint between the housing members 1-64 and 1-66 as well as between 1-66 and 1-74, can be sealed by gasketing or as shown by painting these junctures with a liquid silicone that cures to a solid sealant. Also the margin of the mat flange 1-54 is shown as encircled by a sheet of aluminum foil 1-93 carefully folded around the upper, lower and edge faces 1-94, 1-95, 1-96, and sealed against ledge 1-88 by a sealant such as a self-curing liquid silicone rubber.

It is also helpful to fill the pores of the mat in the outer section of mat flange 1-54, as by impregnating that section with aqueous sodium silicate that dries in place or liquid silicone rubber that cures in place, as indicated at 1-97. Another desirable feature is to water cool the outer margin of the face plate, as by brazing water-cooling coils 1-98 to its lower surface.

In operation the apparatus of FIG. 6 has its table first fitted with the tubes and tube sheets as shown, although there will usually be many more tubes than indicated in the figure, and a quantity of powdered or granular fusible sealing material 1-99 spread over the upper sheet 1-36. The blower 1-24 is started and the table is raised to the position illustrated so that the upper sheet 1-36 has its upper surface and side edges enveloped by the burner. Both sections of the burner are then started, followed by opening of suction control valve 1-32. When the tubes 1-18 are copper or brass with a wall thickness of about 30 mils, and the upper sheet 1-36 is of copper, brass or steel with a width of 8 inches and a wall thickness of about 90 mils, and the burner is burning about 130,000 B.T.U. per hour of combustion mixture, a copper-phosphorus or silver-copper-flux sealing braze will in less than about ½ minute be melted and will flow into and seal each tube to the sheet with a text-book seal, regardless of how many tubes there are. Care should be used when applying the fusible sealing material so that excess material does not plug any tubes; this would impede the flow of hot gas through the tube resulting in uneven heating.

To avoid overheating, the burner is shut off as soon as the sealing is completed, although the suction can be continued. Prolonging the suction helps cool down the heated assembly and thus further reduces surface oxidation.

If the suction is not used during the heating the heat-up of the sheet is not uniform and much more heat-up time is needed before all parts of the sheet are hot enough to melt the sealing material. By that time the outer portions of the sheet are greatly overheated and if not badly damaged can also become sealed to the supports 1-34 even if the upper ends of the supports are about ⅜ inch thick steel. On the other hand when the burnt combustion gases are sucked down the tubes at a speed as low as about ½ linear foot per second the heat-up becomes so uniform that the sealing of all the tubes is completed long before the upper ends of supports 1-34 get hot enough to seal. The portions of the sheet 1-36 touched by the supports 1-34 will not heat-up very rapidly, with or without the foregoing gas flow, and this will also tend to make the immediately adjacent portions of the sheet a little slow in heating-up so that for best results it is desirable to have the tubes at least about ⅜ of an inch away from all supports. Those supports can also carry special fittings that make their upper ends more massive for even greater thermal inertia, but the ⅜ inch spacing of the tubes from their tops is still enough. Where there is considerable hardware around the margin of the tube sheet it is helpful to start the lower section 1-58 of the burner 1-50 before starting the upper section 1-60, and to start the upper section a few seconds later after the margin of the sheet has absorbed sufficient heat to be well on its way to sealing temperature. To guard against misoperation, air without fuel is blown through the upper portion 1-60 of the mat while the lower portion is burning and the upper portion is not burning. This practically equalizes the pressures on both sides of partition 1-66 and thus minimizes flow of combustible mixture to undesired locations where it can be unintentionally ignited.

Filling the mat pores at 1-97 also avoids localized collection of stagnant combustible mixture.

There is no practical upper limit to the speed with which the hot combustion gases are forced down the tubes. There is for example no need for gas-tight connections between the tubes and passageways 1-16; indeed as shown by the open gap between suction tube 1-26 and suction intake 1-29, it is helpful to have air leaks that draw unheated air into the blower along with the hot combustion gases and thus help guard against overheating of the blower.

The tubes 1-18 are themselves not very wide, generally less than a half inch in inside diameter, so that it is difficult to effect extremely rapid gas movement through them. Speeds of 20 feet per second are suitable.

The seals made in a fraction of a minute pursuant to the present invention are found to have far fewer flaws than seals made in two-and-a-half minutes without the use of the gas movement down the tubes. Moreover because of the much greater uniformity of the heat-up the melting and flow of the sealing material is also more uniform so that less sealing material is needed. As compared to the quantities of sealing material ordinarily used in the prior art, about half as much is needed for use with the present invention. Thus for joints in which the tubes have an outside diameter about 2 mils smaller than the diameters of the holes in the sheet, only about one gram of sealing material is needed for every square inch of sheet surface.

Figure 7:
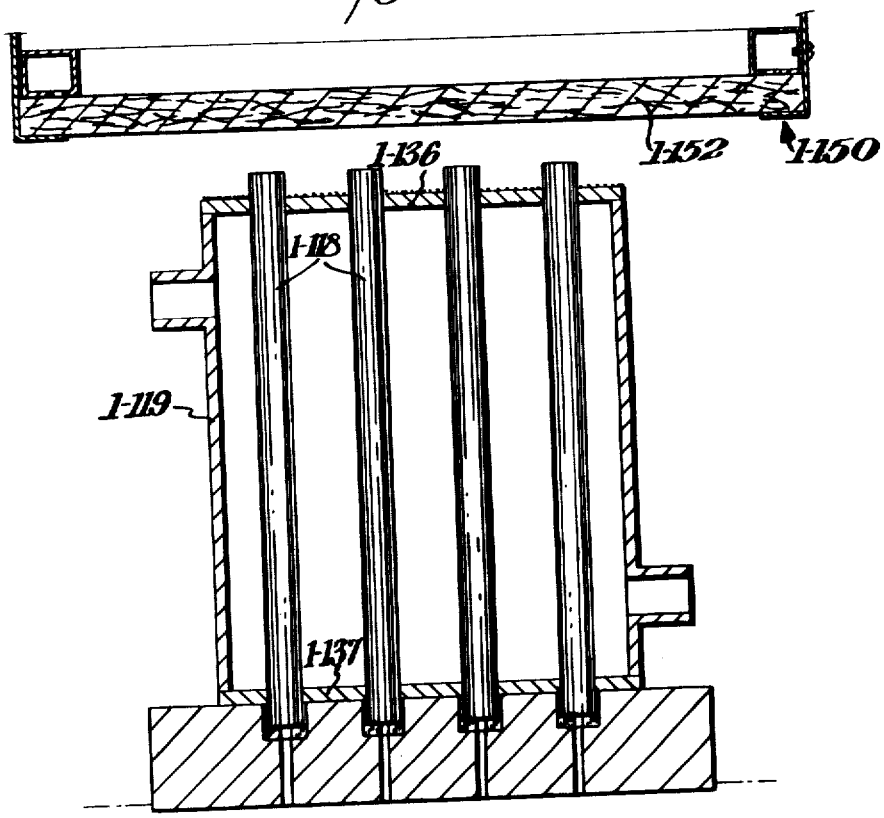
FIG. 7 is a similar view of a modified set-up pursuant to the present invention.

FIG. 7 shows a modified sealing arrangement of the present invention. Here a burner 1-150 having a generally flat burner face 1-152 is used. This extends the heat-up time somewhat as compared to the construction of FIG. 6, and as a result wide assemblies may take as much as 50% more time to seal. However the sealing time is still far less than obtainable from the prior art.

The burner 1-150 of FIG. 7 can be constructed in the manner described in application Ser. No. 674,409, preferably along the lines of FIG. 5 where the ceramic fiber mat has its margin merely fitted to a frame having an inert gas blow-through arrangement in which the inert gas thus blown through the margins of the mat acts to seal those margins against combustible mixture leakage. No other margin sealing is then needed.

In the FIG. 7 arrangement tubes 1-118 are sealed to a sheet 1-136 while the tube-and-sheet assembly is held within a tubular casing 1-119 which eventually forms the shell of the heat exchanger. In about a half minute such an assembly can be sealed following which the assembly is inverted so that the opposite end is similarly sealed, and the sheets are then later brazed or welded to the shell margins. Where the shell is steel of low wall thickness it can be sealed against the sheets at the same time as the tubes are sealed, preferably using the enveloping burner arrangement of FIG. 6.

While suction provides a convenient technique for moving the hot burnt combustion gases through the tubes, they can also be forced through from above. Thus the burner of FIG. 7 can have its frame provided with a depending cylindrical extension that encircles the shell 1-119 and has an asbestos lining pad that closely engages the shell. Operating the burner in such an arrangement causes the hot burnt combustion gases to be discharged downwardly through tubes 118 since they have essentially no other way to escape.

For the purposes of the present invention, brazing is considered a sealing operation in which metal having a melting point at least as high as about 450° F. and generally a copper alloy such as an alloy of 45% silver with 55% copper by weight, is the sealant. Brazing temperatures can go as high as 1300° F. or even higher. Flux such as borax is frequently used with the brazing metal to protect it and the parts being joined against excessive oxidation and to promote wetting of the parts by the melted braze. Some brazing metals are copper-phosphorus alloys or other alloys that can be used without a flux.

The heater in the sealing apparatus of the present invention can be operated continuously while sealing a succession of assemblies, but is preferably operated only for short intervals while the sealing metal is being melted and flows into place. Thus the heater can be completely shut off between sealing sequences, and ceramic fibers burners are particularly helpful in such intermittent operations inasmuch as they heat up and cool down in only a few seconds. For such intermittent operations it is also helpful to have the burner plenum of relatively small volume, preferably not over about 1½ inches deep. In this way combustion gas can be intermittently fed to the plenum and rapidly reach the exit surface of the fiber mat where it is burned, so that the timing of the burner action is simplified.

An igniter such as a pilot light assembly or an electric spark ignitor can be fitted near the margin of the burner to assure that it lights up each time a combustion gas feed is initiated. A settable automatic switching sequencer can be used to time the gas feed to the different burner portions as well as the suction blower.

Instead of, or in addition to, moving the table up and down to bring the work to the burner, the burner can be moved toward and away from the table. In the construction of FIG. 7 no vertical movement is needed by the table or the burner.

An auxiliary heater can also be provided around and above the lower tube sheet 1-37 in the construction of FIG. 6, and operated to seal the lower tube ends into that sheet while the tube-and-sheet assembly is held in the illustrated position. Thus a layer of sealing mixture can be applied to the upper surface of the lower sheet and the auxiliary heater started even before the burner 1-50 is lit inasmuch as the heat-up of the lower sheet takes longer than that of the upper sheet.

Where the margin of a ceramic fiber mat has its pores well sealed, as by the silicone or sodium silicate or other alkali metal silicate impregnant, the mat margin can be clamped in place without wrapping the aluminum foil 1-93 around those edges. The aluminum foil or other gasketing can still be inserted between the mat margin and the plenum margin, or the silicone or alkali metal silicate can also be used to seal the mat edge to the plenum.

According to the present invention a gas-fired radiant heater of the foregoing type having a porous refractory panel through the thickness of which a combustion mixture is passed and which is mounted by its edges, has a narrow stream of non-combustible gas such as air passed through the panel all along its edges, in an amount that without further help keeps the combustion mixture from escaping through the panel edges. The porous refractory panel can be flat as in FIG. 7, convex, concave, cup-shaped, hat-shaped, or have any other desired configuration.

An even greater simplification of the foregoing heater construction and operation is effected by squeezing the panel margins so that they are compressed at least about 10% from their uncompressed thickness, inasmuch as this simple expedient also helps reduce the escape of gas through the panel edges. When combining a marginal gas stream seal with the edge compression, very effective edge sealing is accomplished with only a fraction of the flow of non-combustible gas otherwise required. With either arrangement however, no other assistance is needed to seal against edge leakage of combustion mixture, and edge impregnation as well as the edge wrapping of the panel is completely dispensed with.

Figure 8:
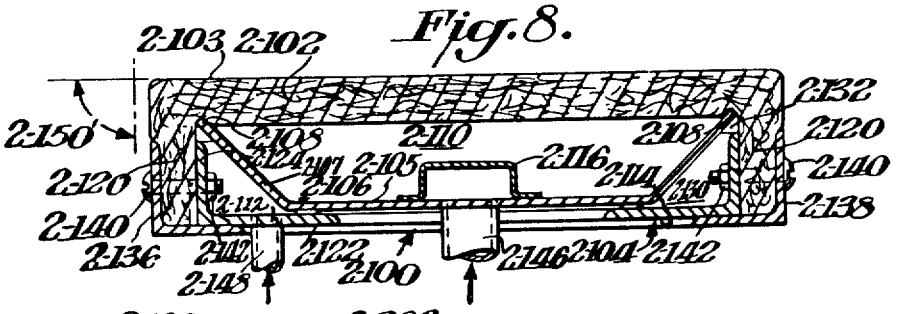
FIG. 8 is a sectional view of a gas-fired radiant heater according to one aspect of the present invention.

FIG. 8 illustrates a heater 2-100 with the improved edge sealing. Heater 2-100 has a cup-shaped panel 2-102 of interfelted refractory fibers clamped by its edges around a support assembly 2-104 made of stainless steel or other metal members shaped from relatively thin stock, about 1/16 inch thick. A central dish 2-106 has a floor 2-105 and inclined walls 2-107 with raised edges 2-108 against which the panel 2-102 is pressed to define a combustion mixture plenum 2-110. Outer face 2-103 of panel 2-102 is of rectangular shape, and so is plenum 2-110.

Secured to the outer margin of the floor 2-105 of dish 2-106 is a series of angles two of which are shown at 2-112, 2-114, defining a rectangular frame against which the edges 2-120 of panel 2-102 are fitted. These angles are illustrated as having horizontal webs 2-122 welded or brazed to the floor of dish 2-106, and vertical webs 2-124 that approach but do not quite reach the dish edges 2-108. The frame angles define with dish walls 2-107 an outer plenum 2-130 that encircles combustion mixture plenum 2-110 and has a discharge slot 2-132 that is engaged by the margin of panel 2-102. The frame members are mitered or otherwise interfitted at the corners of the frame to minimize, or completely seal the other plenum against, leakage in those locations. Supply nipples 2-146, 2-148 are fitted in openings in the floor 2-105 and one or more of the frame angles 2-112, to deliver, respectively, combustion mixture and non-combustible gas. Baffles such as the U-shaped deflector 2-116 can also be provided to help more uniformly distribute the incoming gases. Inasmuch as air is generally the non-combustible gas that flows through plenum 2-130, a little leakage from that plenum doesn't do any particular harm other than consume a little excess air.

Anchoring of panel 2-102 in place is shown as effected with the help of a series of four or more clamping angles 2-136, 2-138, clamping the panel edges 2-120 against the frame angles, with the help of screws 2-140 that penetrate through aligned openings in the angles and are threaded into self-locking nuts 2-142 mounted in webs 2-124 as by securing clips or welding. The screws which need be no thicker than about 3/16 inch, are readily pushed through the edges of the panel without seriously damaging the panel, and any damage that might promote gas leakage is more than compensated by drawing up the clamps sufficiently to compress the panel edges. Standard panels have a wall thickness of about 1⅛ inches and an interfiber spacing such that more than half that thickness is fiber and binder, so that compressing the edges to reduce the overall thickness only about 10%, sharply reduces the air space between fibers and greatly limits leakage.

However very effective panels of interfelted fibers can be made by needling a mat of such fibers without the help of binder. Such needled panels can be extremely pliable, as compared to molded binder-containing mats that are stiff like boards, and can have their edges compressed down to as little as about 30% of their uncompressed thickness. Even compressing such edges that are originally about one inch thick down to about ⅜ inch provides an extremely effective back-up for the air seal.

For such pliable panels it is preferred that the edge compression be down to about half the original thickness, or less. If desired however a pliable panel can be stiffened over its edges alone, or over its entirety, as by impregnating it with a water solution of starch or the like. In such stiffened condition, the degree of edge compression can be reduced.

To reduce any effect that the compression may have in breaking panel fibers that are binder-impregnated, the panel edges to be compressed are first dipped in water or other solvent for the binder carried by the fibers. Such wetting makes the edges more readily deformable so that the compressing is easily effected without seriously stressing the clamping structures. To assure uniformity of compression of board-like panels, the screws 2-140 are no more than about 8 inches apart when the angles have the above-noted wall thickness. Where the heaters are operated in confined spaces so that the clamping angles are subjected to considerable reflected heat, it is helpful to cut slots about six inches apart through the vertical webs of those angles, to allow for thermal expansion and contraction without distortion of the support. Such slots need only be about 20 mils wide, but can be omitted where the clamping angles do not engage each other at the corners of the frame so that expansion is possible at those corners.

A feature of the heater construction of FIG. 8 is that a plurality of such heaters can be juxtaposed to make an effectively continuous radiant heating assembly that covers an extended area. Thus individual heaters are conveniently made with rectangular heater faces about one foot by two feet in size, larger sizes of stiff board-like panels being somewhat awkward to manufacture because the molding and handling is more difficult. However by making the smaller sized panels so that their edges 2-120 are bent down at least about 90 degrees from the plane of the panel body, considering such edge as a flange bent down from a flat sheet, and locating the edge mountings so they are at least partially inboard of the outer face of that flange and not projecting beyond that face more than about 5 millimeters, they juxtapose in a very desirable manner as illustrated in FIG. 9.

Figure 9:
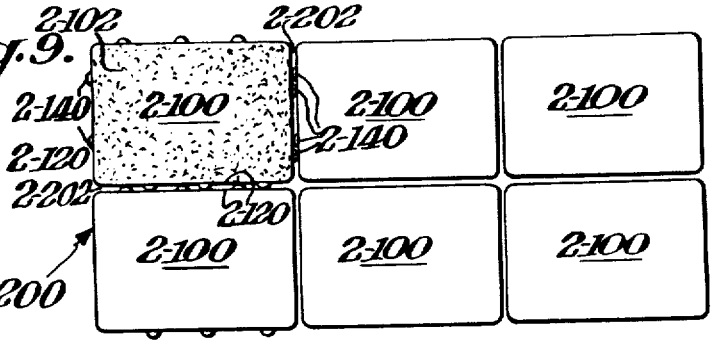
FIG. 9 is a plan view of an assembly of heaters of the type illustrated in FIG. 8.

In FIG. 9 an assembly 2-200 of individual heaters 2-100 is made with the adjacent faces of their panel edges 2-120 about 3 millimeters apart as indicated at 2-202. The margins of the panel faces 2-102 can be made so that they have an essentially zero radius of curvature where they bend into the edges 2-120, but it is sometimes simpler to make them with a radius of about ⅛ inch, and the foregoing 3 millimeter spacing of such rounded corners does not significantly detract from an effectively continuous heater surface junction, particularly where the combustion mixture is arranged to burn over the entire rounded corner. Increasing the spacing from about 3 millimeters to about 5 millimeters does made a significant discontinuity in the radiation uniformity but this can generally be tolerated. Spacings up to about ½ inch or even up to about ½ inch can also be used.

While the clamping screws 2-140 are shown as having round heads and thus project out the furthest from the outer faces of the refractory panel edges, such projection is not a problem so long as it is not over the 5 millimeter limited noted above, or the preferred 3 millimeter limit. These screws can be in unsymmetrical locations along each edge, so that the screws on one heater are offset from the screws of an adjacently positioned heater, as also illustrated in FIG. 9. Indeed the round-head screws can be replaced by socket-head screws which project a trifle more but are easier to install during manufacture. Flat-head screws can alternatively be used with the screw openings in the clamping angles countersunk so that the screw heads do not project beyond those angles, if minimum or zero spacing 2-202 is desired.

The burner construction of FIG. 8 can also have panels of the pliable needled type described above. Such a pliable panel behaves very much like a blanket, and can have its edges folded and tucked in place between the side anchorage members. Because of their high pliability, the corners of such panels will squeeze into shape, although it may be helpful to cut away all excess corner material, and to even notch out some of the panel corners to make it easier to clamp these panels into place. It is preferred to confine any notching to portions of the corners covered by the anchorage members so as to reduce the leakage of gas at the notches.

It is not necessary to have the entire margin of each refractory panel 2-102 flanged over as at 2-120. Thus each of the panels in FIG. 10 has at least one margin that is not juxtaposed to another panel, and some have two such non-juxtaposed margins. Where only two panels are to be juxtaposed, each can have only one margin provided with a flanged-over edge 120, in which event the remaining three margins can have simple constructions as shown in the flat panel exemplifications in the parent applications as well as in FIGS. 10 and 11.

Very close juxtaposition can also be provided by molding or shaping juxtaposed edges 2-120 so that they are bent down more than 90 degrees from the horizontal as measured by the angle 2-150 in FIG. 8. A panel can thus be molded around a suitably shaped molding screen with as many as three of its four sides having flanged edges bent as much as 100 or 110 degrees measured at angle 2-150, and the thus molded panel can then be slipped sideways off the mold in the direction away from its fourth side. Where only one flanged edge margin is desired, it can be made when molding the panel, or by bending down the edge of a flat-molded panel, after that edge is softened by wetting.

Figure 10:
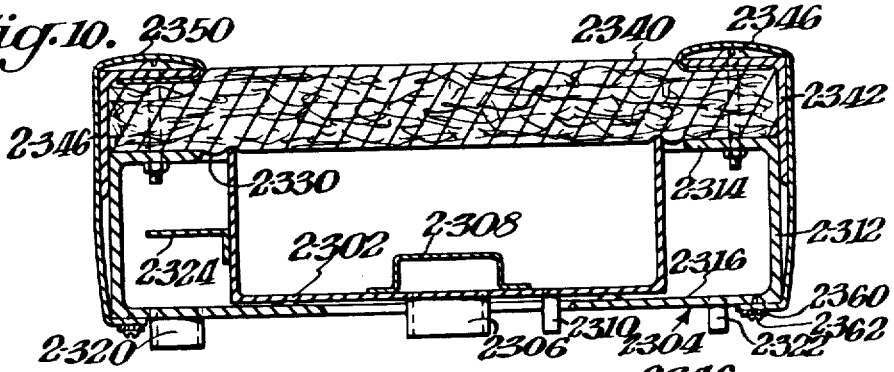
FIG. 10 is a sectional view similar to FIG. 8 of a modified heater construction pursuant to another aspect of the present invention.
Figure 11:
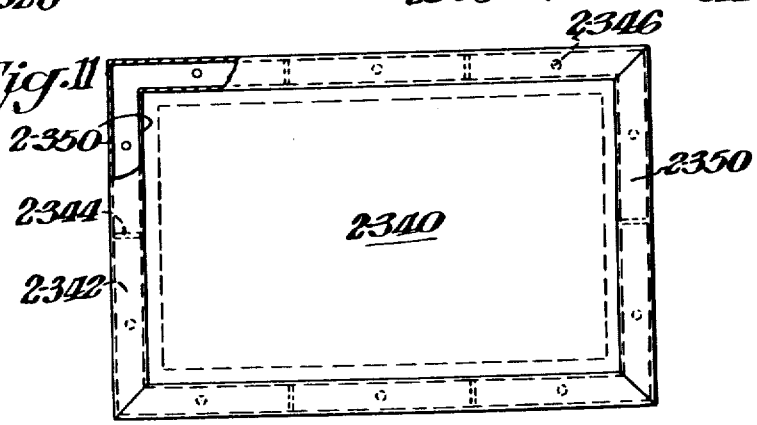
FIG. 11 is a plan view of the heater of FIG. 10.

The construction of FIGS. 10 and 11 is one for flat heater panels easily manufactured from readily available sheet metal. It has a panel support which is a welded-together assembly of a rectangular plenum box 2-302 and a hollow-centered rectangular encircling plenum tube 2-304. Plenum box 2-302 is conveniently prepared by suitably notching out the corners of a rectangular sheet, then bending up the four wings thus formed, and welding the resulting corners gas tight. A hole can then be punched in the floor of the box to receive a PTM half close nipple 2-306 also welded on gas tight. A baffle 2-308 can also be spot welded over the hole to distribute the combustion mixture fed through it. If desired an extra tap 2-310 can also be provided at a second hole in the box floor, for a pressure gage or the like.

Tubular plenum 2-304 is easily made from sheet metal bent into the shape of a channel having a web 2-312, and unequal flanges 2-314, 2-316. The channel is cut into four lengths each of which is mitered and then welded together gas tight, if desired. The tubular plenum can then be affixed to the plenum box as by spot welding the flanges 2-316 to the floor of the box. A gas inlet 2-320 in the form of half a close nipple can be affixed to the tubular plenum, along with an extra tap 2-322 in the same manner as for the box plenum, and a baffle 2-324 can be fixed over inlet 2-320 by spot welding to either the outside of the box plenum or the inside of the tubular plenum.

A slot 2-330, preferably ¼ to ½ inch wide, encircles the top of the box plenum. The refractory matrix 2-340 is clamped in place by a clamping frame 2-342 of angular section as illustrated in FIG. 10 and having slits 2-344 cut in the web overlying the face of the panel as shown in FIG. 11. The slits can be about 8 inches apart and preferably 1/16 inch wide to take care of the most severe thermal conditions. The clamping frame is secured by screws 2-346 as in the construction of FIG. 8, although sheet metal screws can be used instead in either construction, in which event the nuts can be omitted and if desired locking washers fitted under the screw heads.

In severe thermal conditions, such as firing face down or when firing directly at opposing burners, it is desirable to insulate the clamping frame-2-342 from the radiated and convected heat by over-wrapping with a high temperature insulating material such as mineral fibers felted or needled in blanket form. FIG. 10 shows a fiber blanket 2-350, approximately ½-inch thick, clamped and compressed between clamping frame 2-342 and refractory matrix 2-340, wrapped around the clamping frame 2-342 and web 2-312 and secured to flange 2-316 by means of clamp 2-360 and sheet metal or other screws 2-362. The fiber blanket 2-350 insulates the clamping frame from convected heat and its pure white color reflects some radiated energy from opposing burners making the system more efficient. In very high ambient operating conditions it may be desirable to completely wrap the non-radiant surfaces of the burner of FIG. 10 with the fiber blanket.

Figure 12:
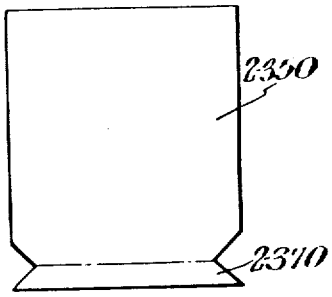
FIG. 12 is a plan view of a component of the structure of FIGS. 10 and 11.

FIG. 12 shows the fiber blanket 2-350 as prepared for installation, having a tuck-in margin 2-370 which is inserted under the face of clamping frame 2-342.

In less severe applications it may be desirable just to cover the face of 2-342 and hold the blanket in place with the screws 2-346 and washers under their heads.

Figure 13:
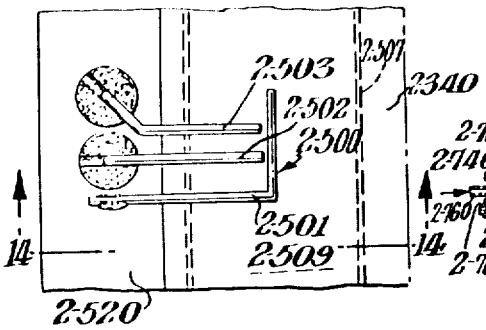
FIG. 13 is a broken-away plan view of a portion of a heater showing a detail feature suitable for use according to the present invention.
Figure 14:
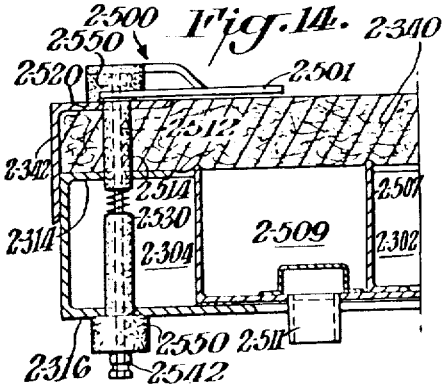
FIG. 14 is a sectional view of the construction of FIG. 13, taken along line 14—14.

The radiant heaters of the present invention can be equipped with automatic igniters such as electric spark igniters or pilot lights. FIGS. 13 and 14 show a particularly desirable automatic igniter construction fitted into a heater of the type illustrated in FIGS. 10 and 11. A standard combination 2-500 of spark rod 2-501, ground rod 2-502 and flame-checking rod 2-503 is mounted so that the rods are generally parallel to and about 1/16-inch above the outer face 2-505 of the porous refractory panel 2-340. Below the opposite face of the panel underneath the rod assembly, the box plenum is provided with a partition 2-507 that isolates a chamber 2-509 from the remaining space in the box plenum, and the chamber is fitted with its own supply connector 2-511 to receive a separate combustion mixture.

The spark rod 2-501 and flame-checking rod 2-503 are each housed in two identical insulators 2-550 which go through aligned openings punched in the top flange 2-520 of the clamping frame 2-342 and in the flanges 2-316 and 2-314 of plenum 2-304 as shown in FIG. 14. Ground rod 2-502 is welded or brazed to flange 5-520. The ends of rods 2-501 and 2-503 projecting out through flange 2-316 are threaded to each accept a connector 2-542 which holds them in place and provides a ready connection for necessary wiring.

The construction of FIGS. 13 and 14 is operated to start the burners using a safety check. A separate pilot combustion mixture is first started into chamber 2-509 and at the same time the spark rod is electrically energized to begin sparking. If the flame rod does not sense a flame within a short period of time, such as 10 to 30 seconds, the flow of combustion mixture can be automatically cut off and the starting sequence must then be manually recycled, preferably after the combustion mixture flow is checked as by purging chamber 2-509. When the starting sequence causes ignition of the separate combustion mixture, the flame-checking rod 2-503 senses the ignition and opens the valve that feeds the main combustion mixture into plenum 2-302 which is then ignited by the flame at chamber 2-509.

By using a small chamber 2-509 with a low BTU/-hour input for the automatic ignition test, the danger of explosion at ignition is minimized. A chamber volume of about 100 cubic centimeters or less is very effective for this purpose.

The pilot combustion on the radiating surface of the panel contributes to the overall radiation.

The spacing of the rod assembly from the refractory panel is preferably kept very small so that the rods do not interfere with placing the radiating surface close to the material being irradiated, such as a moving textile web that is being dried. Because the effectiveness of the heater increases when brought close to the material treated, the spacing of the panel from that material is sometimes arranged to be as little as two inches or even less.

Figure 15:
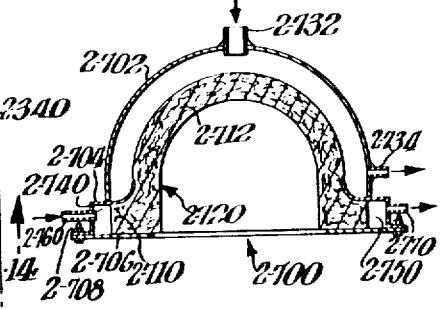
FIG. 15 is a sectional view of a different heater construction purusant to a further aspect of the prsent invention.

FIG. 15 illustrates a radiant heater 2-700 of the present invention particularly adapted for the sealing of metal tubes in a metal sheet in accordance with the technique described in connection with FIGS. 6 and 7. Heater 2-700 has a dome-shaped holder 2-702 welded gas-tight to a support ring 2-704 that is shaped to fit and receive the brim 2-710 of a hat-shaped refractory ceramic panel 2-720. The crown portion 2-712 of the panel is thus held in spaced relation to the dome-shaped holder 2-702 to define a plenum 2-730 for the combustion mixture to be burned on the concave surface of the crown 2-712. An inlet 2-732 and pressure gauge tap 2-734 are shown as fitted to the holder 2-702.

The brim of panel 2-720 is shown as clamped against support ring 2-704 by a clamping ring 2-706 which is bolted to an extension 2-708 of support ring 2-704 and is offset from it to form a cylindrical wall 2-740 that defines an annular plenum 2-750 for the non-combustible gas. If desired the offset can be made integral with the clamping rings so that support ring extension 2-708 can be in the general plane of the main portion of the support ring. Alternatively wall 2-740 can be divided into upper and lower short cylinders separately integral with the separate rings. An inlet 2-760 and a pressure gauge tap 2-770 are also provided for the annular plenum.

The radiant heater 2-700 can directly replace the corresponding heater in FIG. 6, even though heater 2-700 has only one combustion zone. Non-combustible gas pumped into plenum 2-750 of heater 2-700 flows through the brim 2-710 of the porous refractory panel 2-720 and keeps the combustion mixture fed through plenum 2-730 from reaching the lowest portion of the internal surface of the panel where it is aligned with plenum 2-750. No external cooling coil or jacket is needed for the heater 2-700, inasmuch as the non-combustible gas emerging from the lower portion of the interior of the panel flows outwardly along the bottom of clamping ring 2-706 and keeps it as well as the associated metal parts sufficiently cool. Holder 2-702 as well as the remaining members that hold panel 2-720 can all be made of aluminum about 60 mils thick.

Another feature of the present invention is that the heaters with the air seal construction are particularly suited for use in house hot air and/or hot water heating furnaces. The air seal effectively prevents diffusion of the combustion mixture to edge locations where it can burn at a low feed rate and thus gradually burn back deeply into the binder holding the refractory fibers, eventually creating a line of weakness at which an unneedled panel tends to readily break. Indeed the burn-back can sometimes burn back far enough to cause ignition within the mixture plenum itself, rendering the heater unsuited for continued operation. The edge seal construction of the present invention accordingly provides a very long life for the refractory panel, and is also so simple that is is inexpensively constructed and thus more attractive for relatively small home-type equipment.

The needled ceramic fiber panels described above are conveniently manufactured in very long lengths, as long as 25 feet or even longer. Such panels are particularly suited for use with very long radiant heaters, and a construction of this type is shown in FIG. 18.

Here a ceramic fiber panel 2-1010 about fifteen feet long about about one foot wide, has its edges clamped against the face of an air seal plenum 2-1020 surrounding a rectangular combustion mixture plenum 2-1030. Angles 2-1040 compress and clamp the panel edges, being drawn against the air seal plenum face by screws 2-1050 that can be fitted with shoulders 2-1052 against which they can be tightened at relatively high torque with a mininum of attention.

A panel 2-1010 that is not stiffened with binder or the like, will belly out as shown at 2-1060, under the influence of the pressure of plenum 2-1030. This is not particularly harmful, and is in some respects desirable because it reduces the heat radiation from the face of the panel to the clamping angles.

The bellying action can be reduced by pretensioning the panel when it is mounted, or mounting against the outer face of the panel a wire hold-down screen that holds the entire face of the panel in essentially flat condition. The wire of the screen can be made of heat-resistant material like nichrome. Such a hold-down screen can extend from one end of a burner to the opposite end, but need not extend over the entire width of the panel. Thus a matrix panel 7 feet long and one foot wide, and of readily bellied-out construction, will be adequately held with its outer face essentially flat by a long 20-mesh nichrome wire screen 4 inches wide having its ends clamped under or welded to the hold-down frame to position the screen along the central 4-inch width of the panel.

Another technique for stiffening a pliable panel is to needle it around a stiffener as shown in FIG. 10, for example. In this construction a wide mesh metal screen 2-1102 is laid in between two layers 2-1108, 2-110 of ceramic fibers, and a needling operation then performed to interfelt the two fiber layers.

The panel can also be stiffened by encircling it with a metal frame to which its edges are secured as by silicone resin or other high-temperature-resistant adhesive. Such a frame need not have a face flange like flange 61 of FIG. 2, and can be fitted to a burner body as by screws threadedly engaged between the panel frame and the burner body. Stiff binder-containing panels can also be mounted in this way.

A peripheral stream of non-combusting gas can with such a framed panel, be passed through the panel near its margin, or passed over the frame on the outside of the panel. Either technique keeps the edge adhesive from destruction by over-heating.

Figure 16:
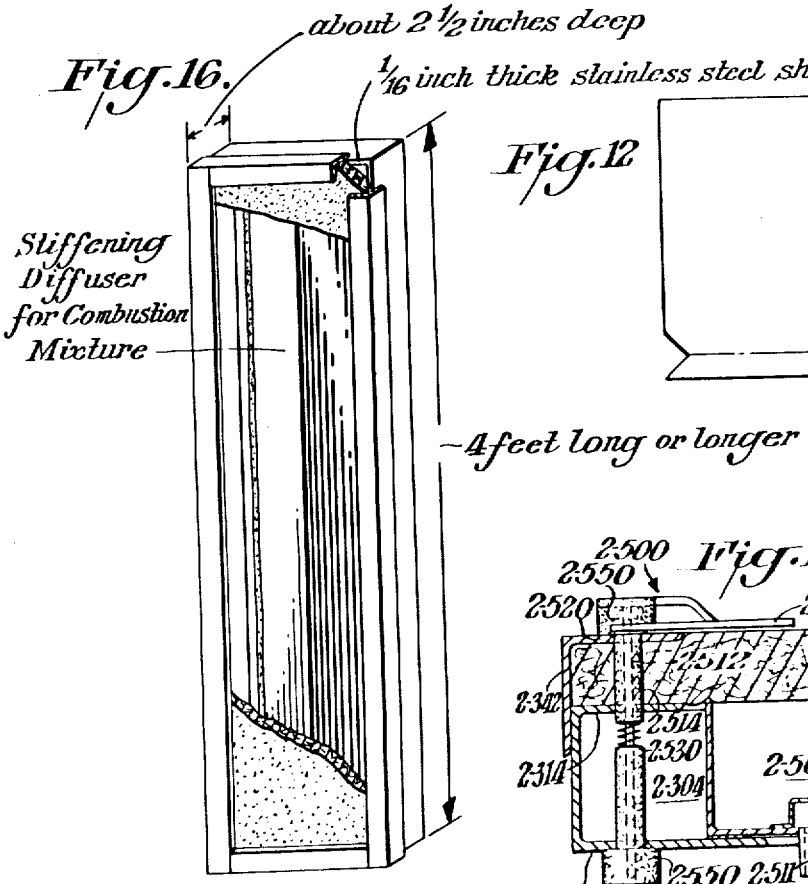
FIGS. 16, 17, 18 and 19 are views of still further embodiments of the present invention.

It is also helpful to reduce the curling or twisting effects caused by differential heating of portions of a burner. Thus burners that are about 4 feet long or longer are best built with extra stiffeners welded onto the burner body and these stiffeners are preferably welded to the inner face of the plenum where they are kept cool by the flushing action of the combustion mixture. A seven-foot-long and one-foot-wide burner body about 2½ inches deep, will show little or no curling even though made of 1/16 inch thick stainless steel sheet, when there is welded to inner face of its combustion mixture plenum a stiffening diffuser that extends the length of the body, as shown for example in U.S. Pat. No. 3,785,763. This is illustrated in FIG. 16. Welding a stiffener on the outside surface of the combustion mixture plenum will generally result in thermal curling apparently because the stiffener tends to heat up excessively in such a location. This problem is not so pronounced where the burner body is 5 or more inches deep or is made of ⅛ inch thick stock of plain carbon steel.

To minimize the thermal twisting of the matrix hold-down frame, which is a member that can get very hot, the matrix can be held in place by a succession of short lengths of angle metal. These can be for instance about 6 inches long, and spaced slightly from the adjacent lengths so that each length is free to expand somewhat as a result of the heating they normally experience.

The individual lengths of hold-down angle can be bolted directly to the back wall of the burner, rather than to the shelf on which the matrix is mounted, to further increase the rigidity of the burner. Such bolts preferably go through the air-seal plenum, as shown for the ignition insulators in FIG. 14, so that they do not have to be fitted to the burner by an air-tight engagement. A little extra air leakage around the bolts does no significant harm.

The short lengths of hold-down angle can also be prepunched with a series of holes in one or both of their flanges, and these holes can be of a size to receive ignition wires or insulators as in FIG. 14. The shelf on which the matrix rests can also be pre-punched the same way. This simplifies the equipping of the burner with electric ignition; it is only necessary to drill out matching holes from the back wall of the air-seal plenum where the ignition connections are to pass through it.

Figure 17:
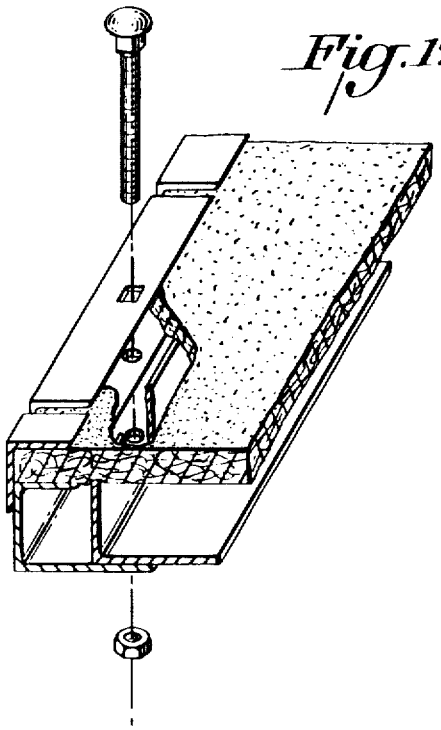

The bolt holes are pre-punched through that back wall, and it is helpful for the bolt holes in the hold-down angle to be square and dimensioned to receive the square shank of a carriage bolt as shown in FIG. 17. Only one bolt per length is required.

The burners of the present invention provide very good radiant heating operation even when facing outward in dusty atmospheres. Combustible particles such as polyethylene are burned away as they fall on the burner matrix, and do not significantly affect the operation. The most serious effect of a dusty atmosphere is generally to disable an electric ignition attachment, and this can be minimized by running the electric current leads from the ignition site through to the air-seal plenum and then along that plenum and out through the air supply conduit connected to that plenum. At a location sufficiently remote from the dusty burner location the ignition wires can be run out from the air supply conduit and connected to the electric ignition control assembly.

To simplify the mounting of the burners, the backs of the burners can have mounting clips welded to them. A simple u-shaped clip can have its central span welded to the burner back to hold the arms of the clip projecting away from the back. These arms can be about an inch apart so that they receive between them a threaded mounting rod the ends of which are fixed in place. The arms can also be provided with small perforations near their ends through which a cotter pin or the like can be passed on the far side of the threaded rod to hold the burner against the rod. Nuts can be threaded on the rod for engagement by the clips, so as to position the burner along the rod.

Obviously many modifications and variations of the present invention are possible in the light of the above teachings. It is, therefore, to be understood that within the scope of the appended claims the invention may be practiced otherwise than as specifically described.

What is claimed:

1. In a gas-fired radiant heater having a porous refractory mat on one face of which a gaseous combustion mixture is burned, and mounting means holds the mat with its opposite face against an open combustion mixture plenum box from which gaseous combustion mixture is passed through the mat so that it can be burned, the improvement according to which the sole structure for preventing movement of the combustion mixture to the edges of the mat from the mat's interior is a second plenum encircling the combustion mixture plenum box and having a plenum face against which the mounting means holds said opposite face of the mat all around the mat margin, the second plenum having narrow slot means along that plenum face through which slot means a different gas can be discharged into said opposite face of the mat to act as a confining barrier around the combustion mixture in the mat.

2. The combination of claim 1 in which the refractory mat is a felted panel of ceramic fibers.

3. The combination of claim 2 in which the porous refractory mat is a needled mat of fibers.

4. The combination of claim 1 in which the mounting means includes a set of metal flanges that encircle the mat and are secured to the second plenum to hold the mat in place.

5. In the operation of a gas-fired radiant heater having a porous refractory mat on one face of which a gaseous combustion mixture is burned, and held by mounting means with its opposite face against an open combustion mixture plenum box from which the combustion mixture is passed through the mat so that it can be burned, the improvement according to which the combustion mixture is kept from the mat's edges only by injecting into said opposite face a narrow stream of a non-combusting gas that surrounds the combustion mixture, the injection being such as to cause that stream to move through the thickness of a mat and emerge from its combustion face still surrounding the combustion mixture.

6. The combination of claim 5 in which the refractory mat is a felted panel of ceramic fibers.

7. The combination of claim 4 in which the outer edges of the mat are not sealed gas-tight.

8. A gas-fired radiant heater having a porous refractory mat on one face of which a gaseous combustion mixture is burned, and mounting means holding the mat with its opposite face against an open combustion mixture plenum box from which gaseous combustion mixture is passed through the mat so that it can be burned, that opposite face having its edges extending beyond the box, a tubular plenum encircles the combustion mixture plenum box and has a series of metal flanges that engage the extending edges of the mat and direct a narrow stream of noncombusting gas from the tubular plenum through the mat edges to encircle the combustion mixture, the flanges being connected to each other with their junctures not sealed gas tight.

9. A process for assembling a gas-fired burner, which process consists essentially of supplying a burner body having a combustion-mixture plenum with an open mouth encircled by a second plenum that provides a slot encircling the mouth, through which slot a narrow stream of non-combusting gas discharges to surround the combustion mixture emerging from the mouth, shaping a piece of porous felted ceramic fiber mat with unsealed edges to cover the mouth and the second plenum, placing the shaped mat over the mouth and second plenum, and then securing the mat in place by its edges.

* * * * *